US008235075B2

(12) United States Patent
Saltel

(10) Patent No.: US 8,235,075 B2
(45) Date of Patent: Aug. 7, 2012

(54) METHOD AND APPARATUS FOR PATCHING A WELL BY HYDROFORMING A TUBULAR METAL PATCH, AND A PATCH FOR THIS PURPOSE

(75) Inventor: Jean-Louis Saltel, Le Rheu (FR)

(73) Assignee: Saltel Industries, Le Rheu (FR)

( * ) Notice: Subject to any disclaimer, the term of this patent is extended or adjusted under 35 U.S.C. 154(b) by 779 days.

(21) Appl. No.: 12/303,474

(22) PCT Filed: Nov. 10, 2006

(86) PCT No.: PCT/EP2006/068361

§ 371 (c)(1),
(2), (4) Date: Dec. 4, 2008

(87) PCT Pub. No.: WO2007/140820

PCT Pub. Date: Dec. 13, 2007

(65) Prior Publication Data

US 2009/0188569 A1 Jul. 30, 2009

(30) Foreign Application Priority Data

Jun. 6, 2006 (FR) ..... 06 04987

(51) Int. Cl.
*F16L 55/16* (2006.01)

(52) U.S. Cl. ..... 138/98; 138/93; 405/184.2; 405/150.1; 166/207; 166/212

(58) Field of Classification Search ..... 138/98, 138/93; 405/184.2, 150.1; 166/207, 212
See application file for complete search history.

(56) References Cited

U.S. PATENT DOCUMENTS

| | | | | |
|---|---|---|---|---|
| 2,812,025 | A * | 11/1957 | Teague et al. | 166/207 |
| 3,618,639 | A * | 11/1971 | Daley et al. | 138/97 |
| 4,009,063 | A * | 2/1977 | Wood | 156/71 |
| RE30,802 | E * | 11/1981 | Rogers, Jr. | 29/421.1 |
| 5,027,895 | A | 7/1991 | Barton | |
| 5,787,933 | A * | 8/1998 | Russ et al. | 138/98 |
| 6,021,815 | A * | 2/2000 | Kiest et al. | 138/98 |
| 6,994,118 | B2 * | 2/2006 | Kiest et al. | 138/98 |
| 7,090,006 | B2 * | 8/2006 | Salama | 166/208 |
| 7,240,697 | B2 * | 7/2007 | Beebe et al. | 138/89 |
| 7,401,647 | B2 * | 7/2008 | Baycroft et al. | 166/277 |

(Continued)

FOREIGN PATENT DOCUMENTS

| | | |
|---|---|---|
| GB | 2 398 312 A | 8/2004 |
| WO | WO 02/052124 A2 | 7/2002 |

*Primary Examiner* — James Hook
(74) *Attorney, Agent, or Firm* — Pauley Petersen & Erickson

(57) ABSTRACT

A method of patching a well or a pipe by hydroforming a tubular metal patch. A tool provided with a pair of inflatable packers is inserted inside the patch. The pair of inflatable packers are axially spaced apart from each other by a distance that is substantially equal to the length of the patch. The tool is positioned inside the patch so that the packers are in register with the end portions of the patch. The assembly of the tool and the patch is axially inserted inside the well or the pipe, and positioned in register with the zone for patching. The packers are inflated to a high pressure, sufficient for radially expanding the end portions of the patch and pressing them in a leak-tight manner against the wall of the well or the pipe. The packers are subsequently deflated and the tool is withdrawn. The method is applicable to the oil industry.

11 Claims, 13 Drawing Sheets

U.S. PATENT DOCUMENTS

| | | | | |
|---|---|---|---|---|
| 7,828,068 | B2 * | 11/2010 | Gano et al. | 166/387 |
| 2002/0020524 | A1 | 2/2002 | Gano | |
| 2003/0136561 | A1 | 7/2003 | Metcalfe et al. | |
| 2004/0020659 | A1 * | 2/2004 | Hall et al. | 166/380 |
| 2004/0074640 | A1 * | 4/2004 | Anderton et al. | 166/277 |
| 2006/0042801 | A1 | 3/2006 | Hackworth et al. | |

* cited by examiner

METHOD AND APPARATUS FOR PATCHING A WELL BY HYDROFORMING A TUBULAR METAL PATCH, AND A PATCH FOR THIS PURPOSE

The present invention relates to a method and to apparatus for patching a well or a pipe, e.g. casing that presents a portion that needs to be treated in order to make it leakproof, in particular for repair and/or plugging purposes.

The invention applies more particularly but not necessarily to producing water or producing oil.

In the description below, the invention is described by way of example in the context of producing oil.

Casing is constituted by a metal tube that lines the inside of an oil well over a great length.

As an indication, this length may, for example, lie in the range 2000 meters (m) to 4500 m, and its inside diameter lies in the range 120 millimeters (mm) to 200 mm.

In its bottom portion, the casing is perforated where it passes through one or more deposits in order to allow the oil or gaseous hydrocarbon to penetrate into the well.

At the top end of the well there is a well head fitted with various systems, in particular for protection, suspension, and sealing purposes.

Over a long length of the top portion of the well, e.g. lying in the range 1500 m to 4000 m, the casing is provided internally with completion equipment comprising tubing and various devices used for operating the well, such as temporary closure members (packers) and safety valves, for example.

Over time, it can happen that a portion of the wall of the casing needs to be made leakproof, in particular when it has been degraded, e.g. by premature wear and/or by cracking, or when the perforations for passing oil need to be plugged, in particular because the deposit has been exhausted in that zone and undesirable fluids (in particular water or gas) run the risk of passing through the wall of the casing and penetrating into its inside.

To do this, the said portion is treated by being coated internally with a protective material, in particular a cement, a gel, or a composite material based on polymerizable resin.

In order to perform this treatment, two different techniques can be implemented:

- either the completion equipment is initially withdrawn, thereby giving direct access to the portion of the casing that is to be treated;
- or else the tools and the material used for cementing are passed through the completion equipment.

The first technique is time consuming and expensive and can lead to operating difficulties, in particular since it is necessary to take the well out of service completely before taking any action.

The second technique is complex, expensive, and can be used only in a limited number of configurations because the completion equipment generally presents a diameter that is considerably smaller than that of the bottom zone of the casing in which the portion for treatment lies.

The invention seeks to mitigate those drawbacks by proposing a method and apparatus that enable the bottom zone of the casing to be lined, but by passing through the completion equipment, of smaller diameter.

The invention applies not only to casing as described above, but also to any well dug in the ground or to any optionally buried pipe, and that is why the description and claims below refer to lining a well or a pipe, where the pipe may be constituted by casing or any other duct that may be vertical, horizontal, or oblique.

The invention thus provides a method of patching a well or a piper e.g. a casing, that presents a portion that needs to be treated, in particular to be repaired and/or plugged.

According to the invention, the method implements hydroforming a tubular metal patch of initial diameter that is considerably smaller than the diameter of the well or of the pipe, the method comprising the following steps:

- axially inserting inside said patch a tool comprising a mandrel on which there are mounted two inflatable packers that can be expanded radially under the action of internal hydraulic pressure, these two packers being axially spaced apart from each other by a distance that is substantially equal to or a slightly less than the length of the patch;
- positioning said tool inside the patch in such a manner that the packers are in register with its end portions;
- axially inserting in the well or the pipe the assembly constituted by the tool and the patch, and positioning the assembly in register with the zone to be patched;
- inflating said packers under high pressure that is sufficient for them to cause the two end portions of the patch to expand radially and to be pressed in leaktight manner against the inside wall of the well or the pipe; and
- deflating said packers and withdrawing the tool from the well or the pipe.

It will be understood that once the assembly made up of the tool (with its non-inflated packers) and the patch carried thereby presents a diameter that is smaller than that of the completion equipment, it is possible to pass it through the completion equipment in order to treat the zone situated beyond said equipment.

Conversely, once said zone has been patched, the deflated tool can be withdrawn by passing in the opposite direction through the completion equipment.

According to one possible additional characteristic for implementing the method, after said packers have been inflated, at least in part, for the purpose of pressing the two end portions of the patch in leaktight manner against the inside wall of the well or the pipe, a second fluid under pressure is introduced into the inside of the patch between the two packers so as to cause the central portion of the patch, situated between its two end portions to expand radially also, by hydroforming, the inflation pressure of the packers being substantially greater than the pressure of said second fluid.

This naturally assumes that the inflation pressure of the packers is greater than the pressure of the second fluid which causes the central portion of the patch to be expanded by hydroforming. To do this, it suffices to reinforce mechanically the end portions of the patch, e.g. by increasing their wall thickness or by adding a ring acting as a hoop.

Thus, the radial expansion of these end portions requires a pressure to be applied that is considerably stronger than that required for radial expansion of the central portion of the patch.

The method is preferably implemented in a plurality of stages.

Each stage comprises two successive phases.

In the first phase, the end portions are caused to expand radially in part so as to obtain a determined increase in the diameter or said portions, with this being done by inflating the packers to a given pressure that is directly a function of the desired increase in diameter. In the second phase, the remainder of the patch is caused to expand radially, i.e. its central portion is caused to expand, by hydroforming under drive from a pressure of smaller value that is selected to obtain a given increase in diameter.

The operation is repeated one or more times until the expansion diameter desired for the central portion of the patch is obtained.

Finally the end portions are subjected to final expansion so that they come to bear intimately in leaktight manner against the wall of the well or the pipe.

This operation in successive stages makes it possible to give the patch a shape that is initially cylindrical or substantially cylindrical; otherwise its central portion would run the risk of presenting a convex bulging or "barrel" shape, or conversely a concave "hourglass" shape due to edge effects.

The number of stages implemented naturally depends on the desired expansion ratio. The number of stages increases with increasing desired expansion ratio.

At each stage, the pressure differential between the fluid for inflating the end packers and the hydroforming fluid enables the hydroforming fluid to be confined inside the patch between the two packers.

According to another possible additional characteristic, once the tool has been positioned inside the patch, the packers are inflated a little. The packers then press with a certain amount of compression against the inside wails of said end portions, such that the tool is secured relative to the patch by friction, with these two elements then temporarily constituting a unitary assembly that is easier to handle and put into place.

According to another characteristic of the method, it can be used to put one or more sensors into place in said zone, either in addition to repairing or plugging a zone of the well, or specially for this purpose alone; to do this, prior to the operation, the sensor(s) is/are secured against the wall of the central portion of the patch, on the outside of said wall.

Thus, at the end of the operation, the sensor(s) is/are located in the annular space between the central portion of the patch and the wall of the well or the pipe, thereby protecting it/them from any tools that might be passed through the patch in future well-management operations.

The apparatus for patching a well or a pipe, e.g. a casing, that presents a portion for treatment, in particular for repair and/or for plugging, as provided by the present invention is apparatus for hydroforming a tubular metal patch of initial diameter that is substantially smaller than that of the well or the pipe.

The apparatus is characterized by the facts that firstly it comprises a tool suitable for being inserted axially inside the patch, said tool comprising a mandrel having two inflatable packers mounted thereon that are radially expandable under the action of internal hydraulic pressure, the two packers in the deflated state presenting a diameter that is less than or equal to the inside diameter of the patch, and being axially spaced apart from each other by a distance that is substantially equal to or a little less than the length of the patch, said tool being adapted to being positioned inside the patch so that the packers are in register with the end portions thereof, and that, secondly, hydraulic means are provided for inflating said packers at high pressure that is sufficient for them to cause the two end portions of the patch to expand radially and be pressed in leaktight manner against the inside wall of the well or the pipe, after the assembly constituted by the tool and the patch has been inserted into the well or the pipe and said assembly has been positioned in register with the zone to be patched.

Furthermore, according to certain characteristics of this apparatus, that are advantageous but not limiting:

- the tool is provided with an axial tube suitable for being selectively connected to a hydraulic source of high pressure or to a source of low pressure, said tube presenting delivery and suction orifices opening out to the insides of said packers; and
- the tool is provided with additional tubes or channels suitable for being connected to a hydraulic source of high pressure, and presenting delivery orifices opening to the outside of the mandrel of the tool, between said packers.

The invention also provides a tubular metal patch for use with apparatus having the above-specified characteristics.

According to possible advantageous characteristics of this patch:

- its end portions are mechanically reinforced, their thickness being greater than the thickness of the central portion of the patch;
- it is reinforced in its end portions by means of an outer ring acting as a hoop and engaged on its wall;
- its end portions are provided with an outer covering e.g. of natural or synthetic rubber, suitable for improving sealing on coming into contact with the inside wall of the well or the pipe;
- said outer coating is of a material that swells, being suitable for expanding on coming into contact with a liquid, in particular with water or with oil;
- the patch possesses a wall that is longitudinally folded, thus encouraging radial expansion thereof by deploying its corrugations under the effect of internal pressure;
- the patch is used for putting one or more sensors into position and it is provided with at least one sensor secured to its central portion, on the outside of its wall; and
- the sensor is housed in a setback in the wall of said central portion.

Other characteristics and advantages of the invention appear from the following description given with reference to the accompanying drawings, in which.

Figure 7:
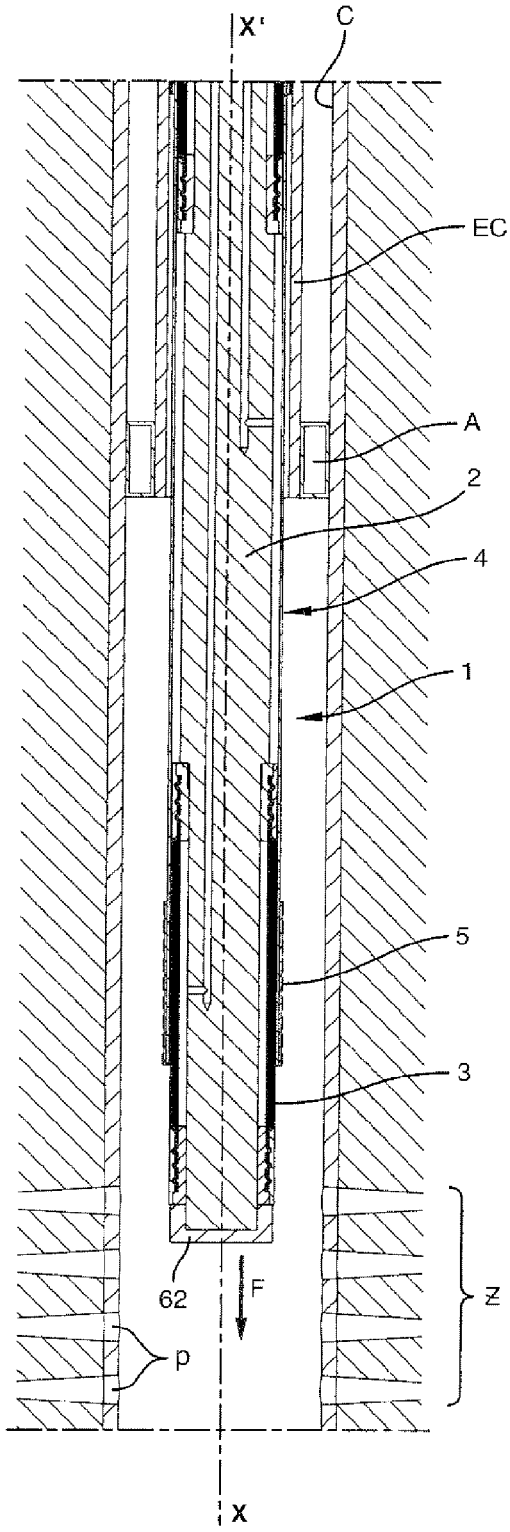
FIG. 7 is an axial section view showing the tool and patch assembly being put into place inside the casing that is to be patched.
Figure 7A:
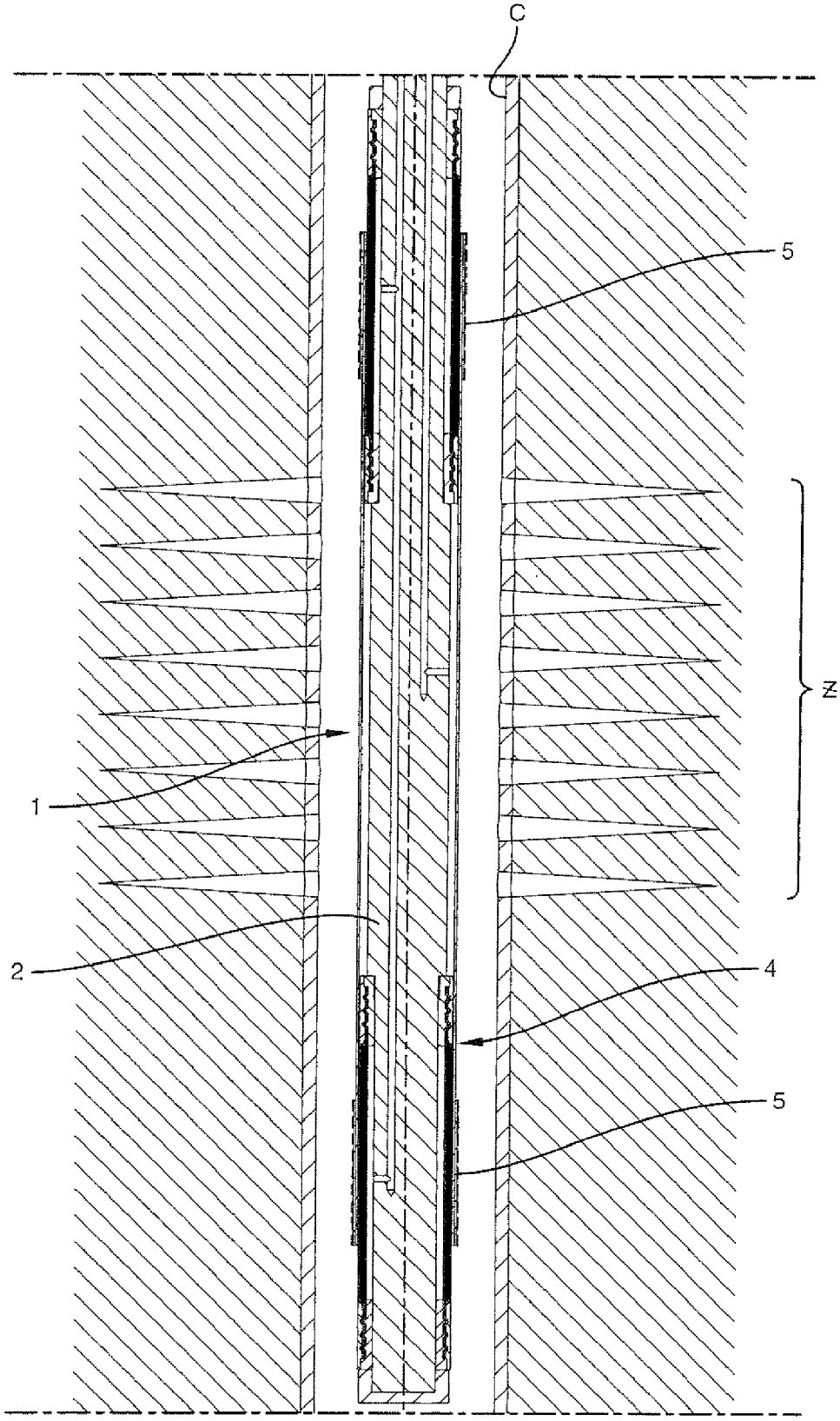
Figure 9:
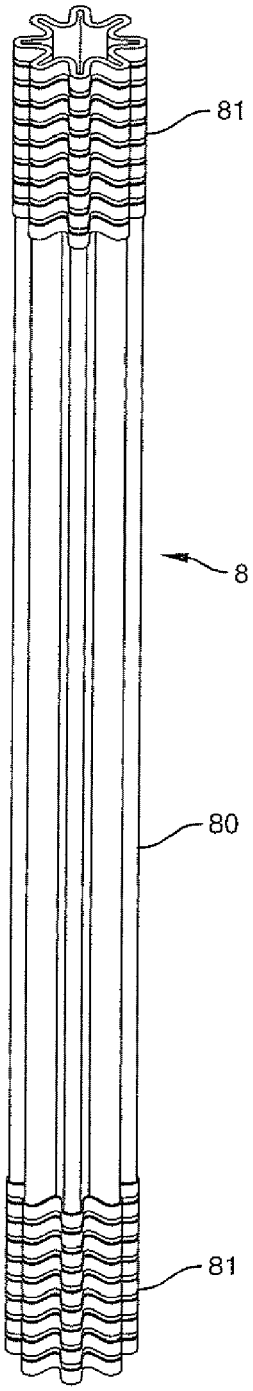
Figure 10:
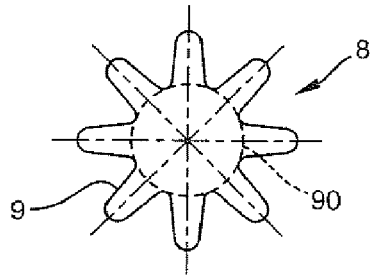
Figure 10A:
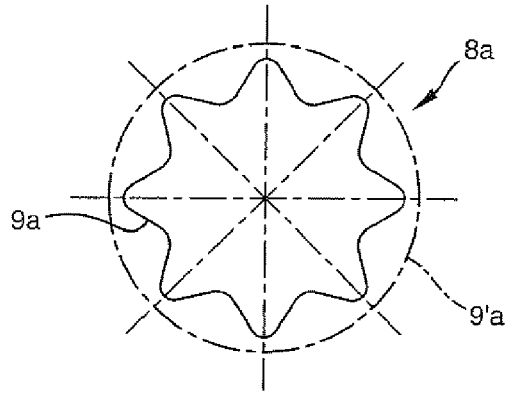
Figure 11:
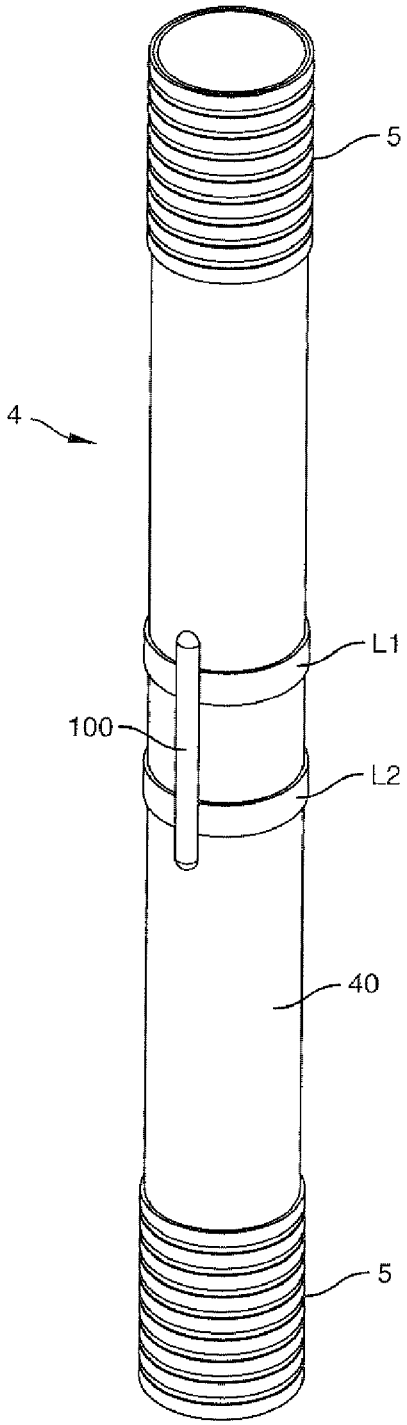
Figure 11A:
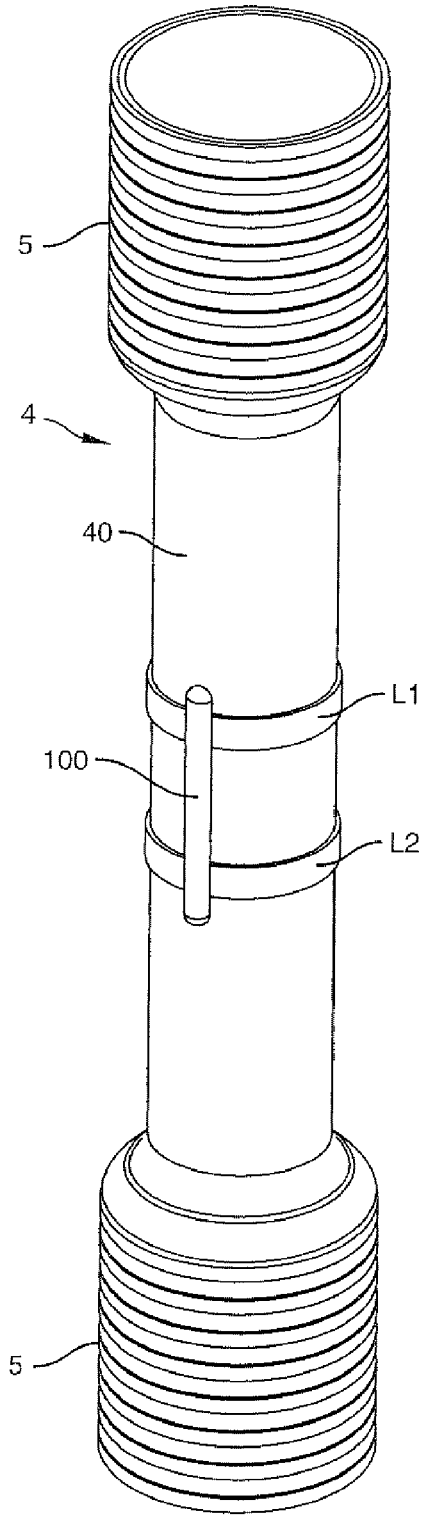
Figure 12:
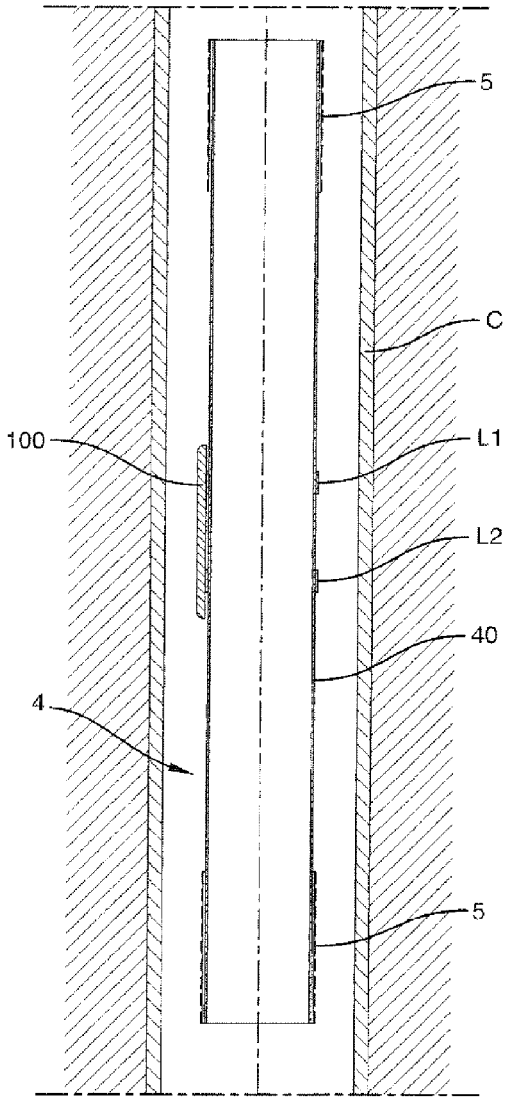
Figure 12A:
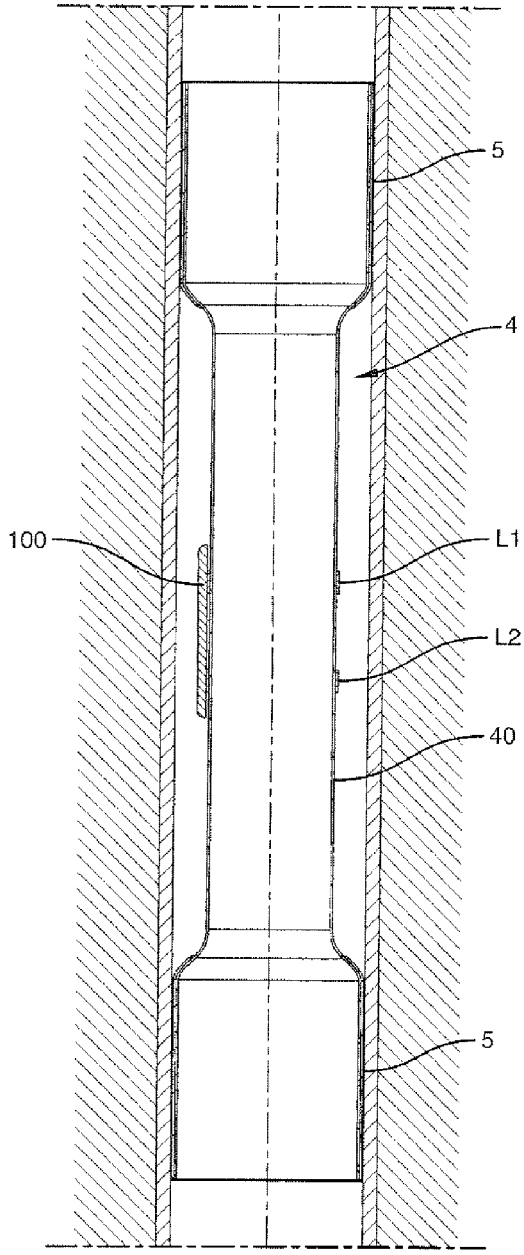
Figure 13:
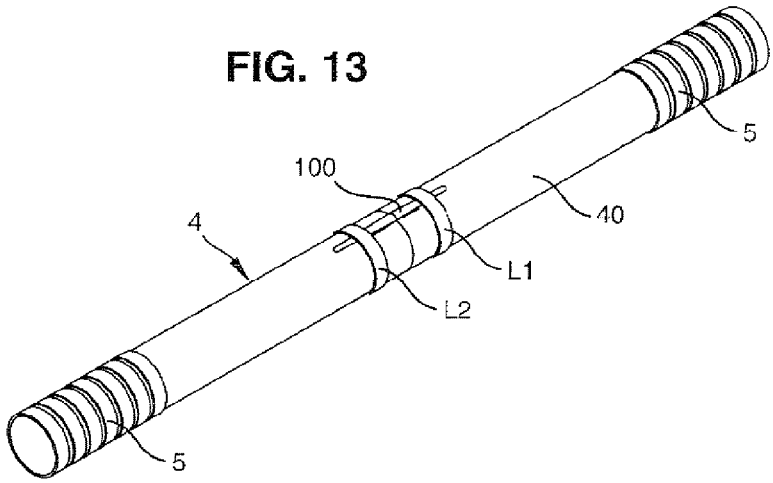
Figure 14:
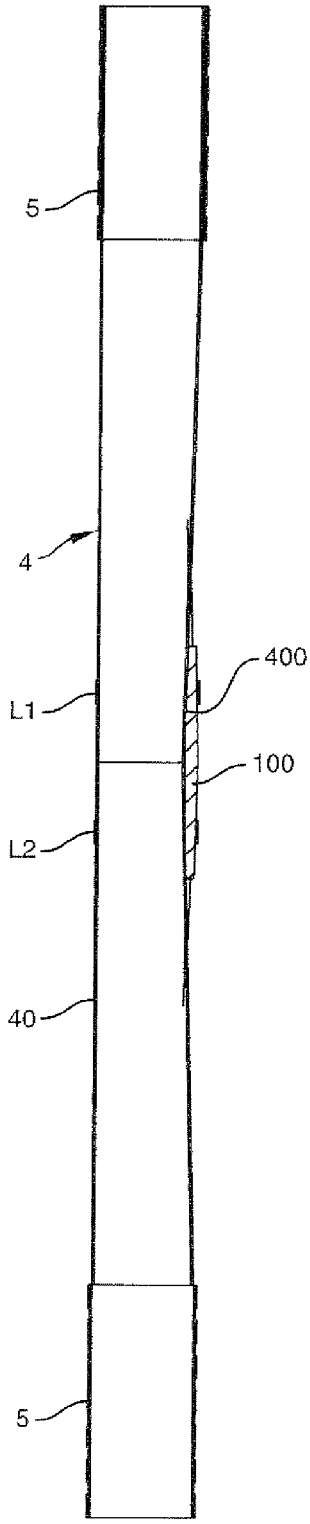
Figure 15:
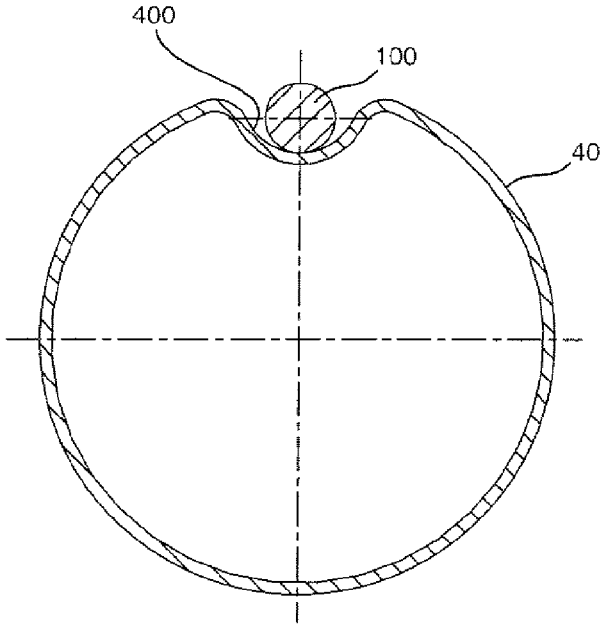

FIGS. 7A to 7'E are views similar to that of FIG. 7 showing various successive stages in the patching operation;

FIG. 9 is a perspective view showing a variant patch with a folded wall;

FIGS. 10, 10A, and 105 are sections through the wall of the patch while radial expansion is taking place;

FIGS. 11 and 11A are perspective views of a patch fitted with a sensor, shown respectively before and after radial expansion;

FIGS. 12 and 12A are views similar to FIGS. 11 and 11A respectively, with the patch being shown in axial section inside casing;

FIG. 13 is a perspective view of a variant of the patch in which its wall presents a setback for housing the sensor; and FIGS. 14 and 15 are views of this variant respectively in longitudinal section and in cross-section (and at a larger scale).

Figure 1:
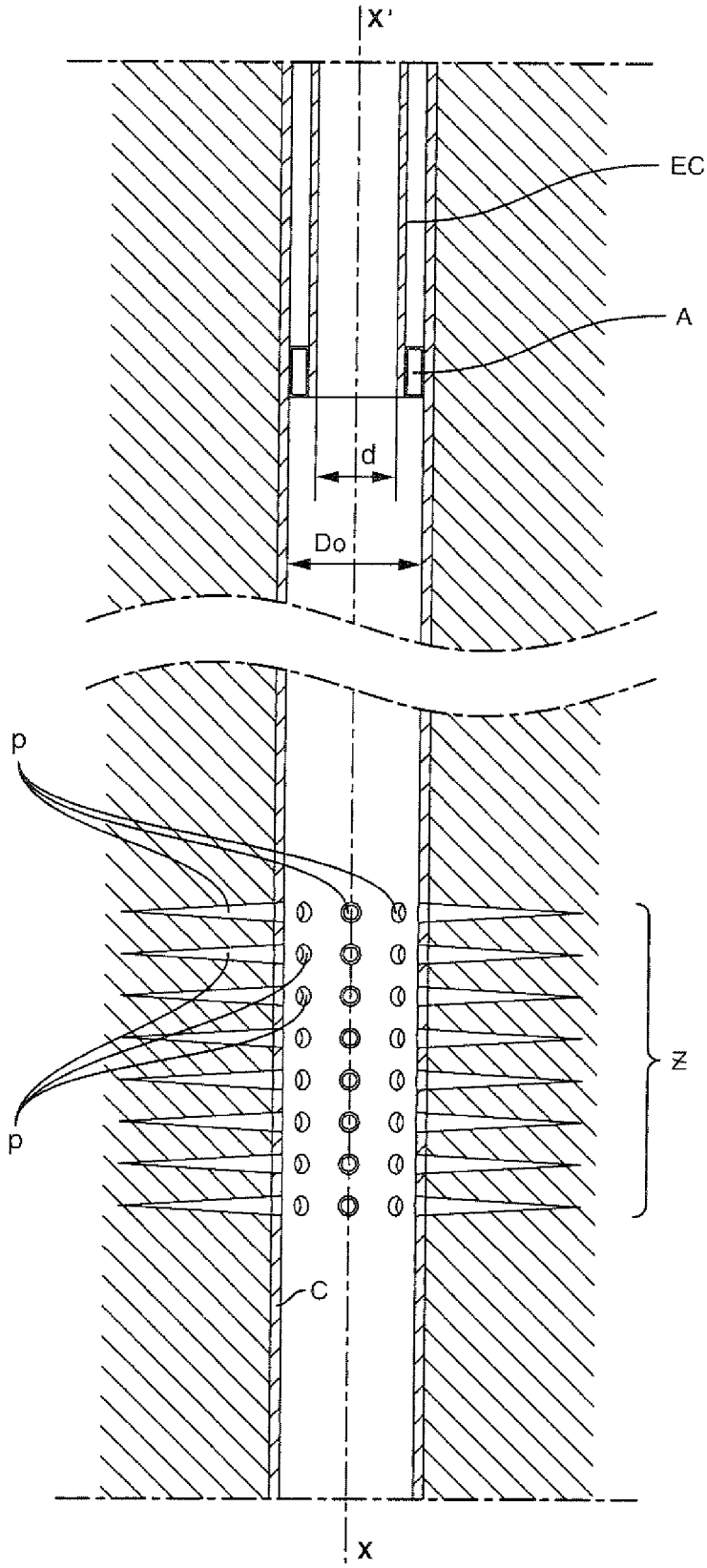
FIGS. 1 and 8 are highly diagrammatic axial section views of a portion of an oil well, respectively before and after patching a damaged zone.
Figure 2:
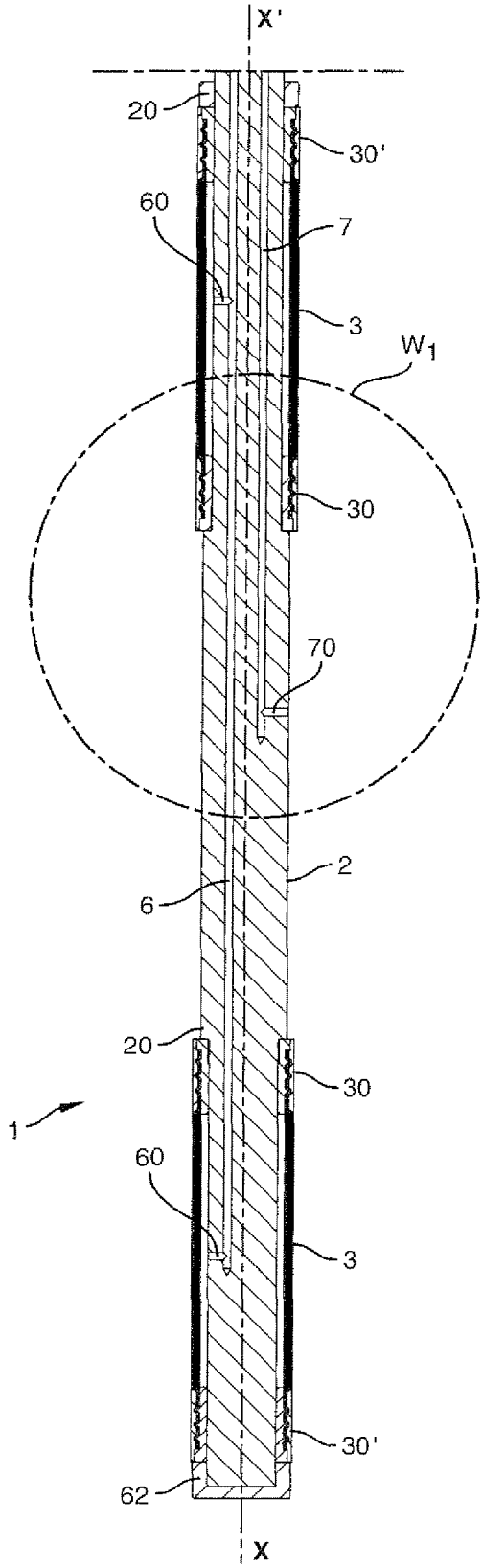
FIGS. 2 and 3 are diagrammatic axial section views respectively of a tool constituting apparatus in accordance with the invention and a cylindrical metal tubular patch for patching the damaged zone of the well.
Figure 3:
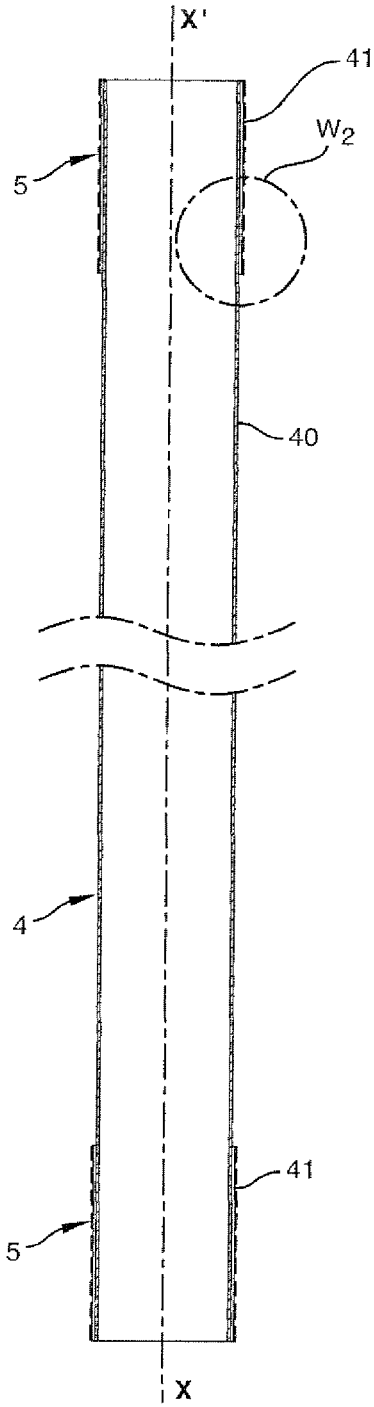
Figure 4:
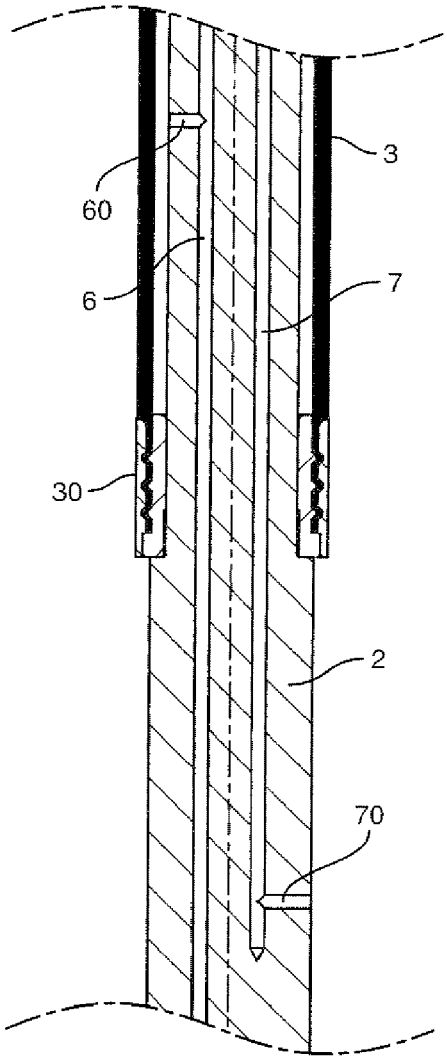
FIGS. 4 and 5 are detail views of banded portions referenced W1 and W2 in FIGS. 2 and 3 respectively.
Figure 5:
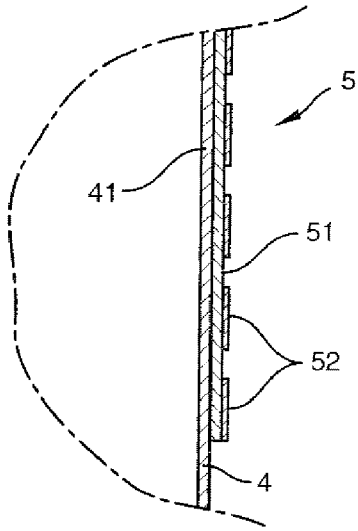

FIG. 1 shows a portion of an oil borehole well lined with casing C and having a cylindrical wall of vertical axis X-X' A segment Z of the casing presents perforations p that are producing water and that it is desired to plug by patching.

Reference EC designates completion equipment held in place by an annular centering member A and of inside diameter d that is considerably smaller than the diameter $D_0$ of the casing.

By way of example, the diameter d is about 100 mm, while the diameter $D_0$ is about 155 mm.

Figure 8:
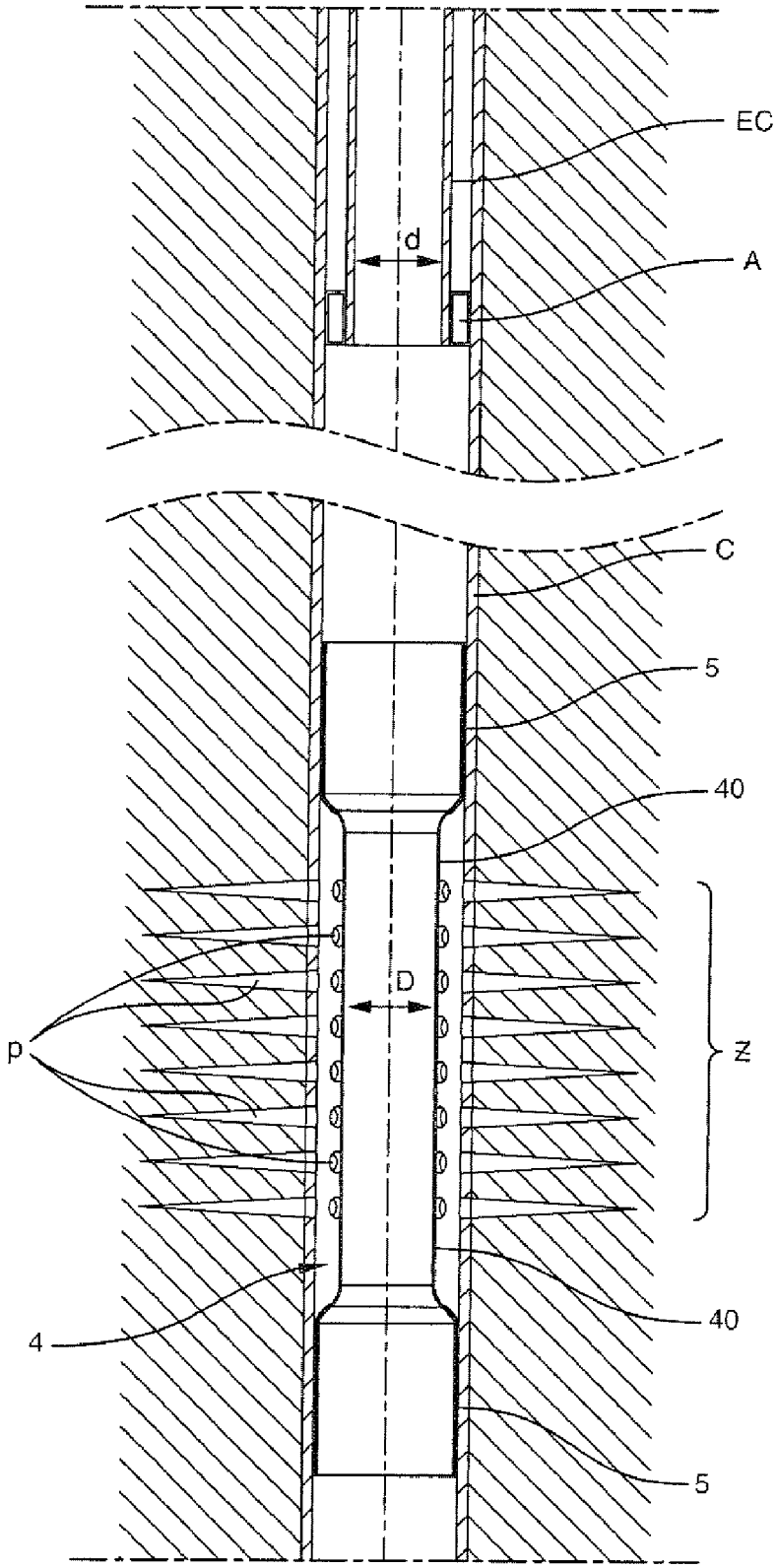

FIG. 8 shows the same portion of the well after a patch 4 has been put into place in the portion Z so as to make this zone leakproof, isolating the perforations p from the inside of the well by interposing a cylindrical metal wall 40.

In order to avoid disturbing operation of the well, it is important for the inside diameter D of said wall to be greater than or equal to d so as to allow access to the bottom portion of the well after treatment by tools that have been able to pass through the completion of diameter d.

As explained below, the invention makes it easy to do so.

The apparatus of the invention shown in FIGS. 2 to 6 comprises a tubular tool 1 essentially constituted by a cylindrical mandrel 2 of axis X-X', e.g. made of steel, and surrounded by a pair of inflatable packers 3 that are likewise cylindrical, each having its wall in the form of a diaphragm of flexible and elastic material that can withstand pressure and corrosion, e.g. of rubber or of elastomer.

The two packers 3 are carried by the mandrel 2 coaxially with the mandrel and situated a certain distance apart in the axial direction.

The diaphragm constituting each packer is secured hermetically at its ends to endpieces 30, 30', one of which is movable axially so as to accommodate the reduction in the length of the packer associated with its radial expansion, and conversely the increase in its length on deflation.

In the embodiment shown, it is the outer endpieces 30' (topmost and bottommost) that are movable, with the inner endpieces 30 being secured to the mandrel 2.

Naturally, this disposition is not essential; in particular it could be inverted.

At its free bottom end, the mandrel carries a cap 62 forming an abutment for the bottom endpiece 30'.

At its opposite end, a ring 20 secured to the mandrel forms an abutment for the top endpiece 30'.

The mandrel presents a longitudinal channel 6 for connection to a source of liquid under high pressure and that opens out through a radial orifice or a plurality of radial orifices 60 into the inside or each packer 3.

Similarly, the mandrel 2 presents another longitudinal channel 7 for connection to a source of liquid under high pressure. The channel 7 opens to the outside in the central zone of the mandrel 2 via a radial orifice or a plurality of radial orifices 70.

These connections are made through suitable distributor valves which, like the sources of liquid under high pressure, can be situated at the well head.

These valves (not shown) serve to connect the channels 6 and 7 selectively and respectively to the hydraulic source of high pressure that is variable and controlled, or on the contrary to a low pressures.

The channels 7 open to the outside of the mandrel 2 via radial orifices 70 between the two inflatable packers 3.

The tool 1 with its inflatable packers 3 has the same structure as a double inflatable packer device of the kind commonly used in the oil industry.

The patch 4 that is to be used for patching purposes comprises a cylindrical tube made of metal, preferably steel, and of relatively fine wall thickness.

Its length corresponds substantially to the length of the tool, and its inside diameter is greater than that of the tool 1 and of its packers 3.

Figure 6:
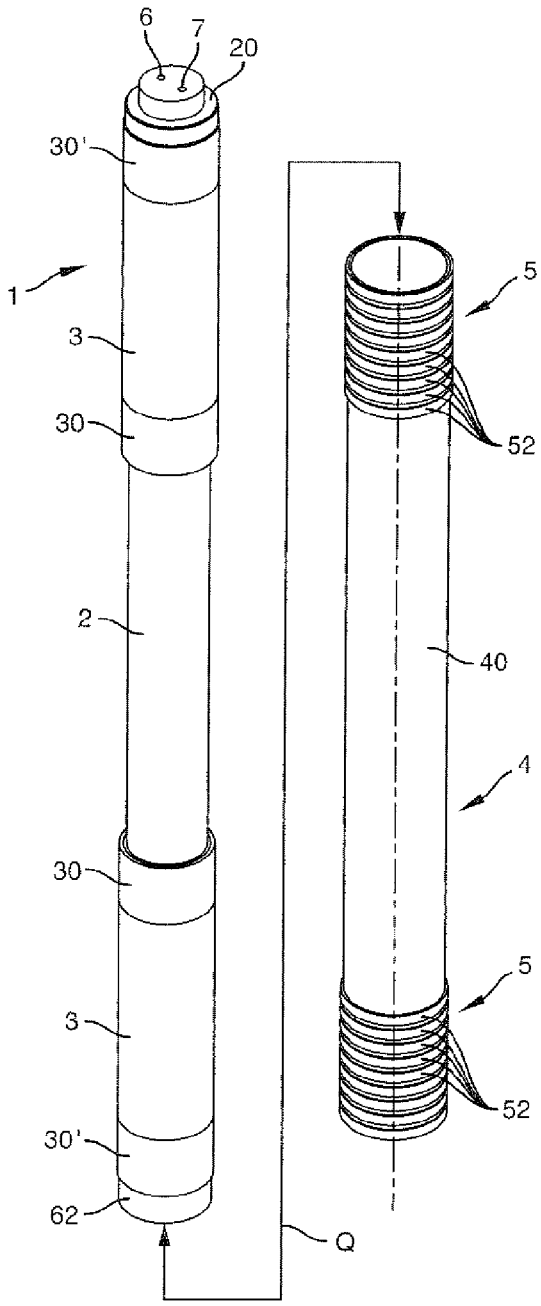
FIG. 6 is a perspective diagram of the tool and of the patch that is to receive the tool axially engaged therein as represented by arrow Q.

The tool 1 can thus be engaged axially inside the tubular patch 4, as represented by arrow Q in FIG. 6.

After engagement, each packer 3 is in register with one of the two end portions 5 of the patch 4. The portions 5 are mechanically reinforced so that their resistance to deformation in radial expansion is considerably greater than that of the central portion 40 of the patch. More precisely, and as can be seen in particular in FIG. 5, the wall of the patch in this zone, referenced 41, is surrounded by a cylindrical metal ring 51, thereby increasing the total thickness of the wall.

These rings, which act as hoops, considerably reinforce the mechanical strength of the wall of the patch in its end zones.

In addition, the ring 51 is provided on its outside with a sealing coating 52.

By way of example, the coating is an annular layer of flexible and elastic material (e.g. elastomer or rubber), that is advantageously crenellated, so as to have circumferential grooves between solid portions in relief, so that each of these portions can deform appropriately when the portion 5 is expanded radially and pressed with force against the casing.

In a variant, the coating layer could be replaced by a series of adjacent O-rings received in grooves formed in the periphery of the ring 51.

As material for making the coating or the O-rings, it is advantageous to use a material that is suitable for swelling on coming into contact with a liquid, in particular the liquid that is present in the well (water, mud, or oil, in particular), so as to further improve sealing.

Materials possessing this property are mentioned by way of example in patent document US 2004/0261990 A1, to which reference can be made where required.

After the tool has been engaged and properly positioned in the patch 4, the packers 3 are inflated a little by delivering fluid under moderate pressure thereto via the channel 6 and the orifices 61, the pressure being sufficient to hold the tool 1 by friction against the patch 4.

These two elements thus form a unitary assembly suitable for being inserted in and moved along the well for treatment. For this purpose, the assembly is suspended from mounting and guide members, e.g. hollow rods of known type of the kind used for putting into place and removing conventional packers. The supply of the liquid under pressure (not shown) takes place via the insides of the suspension rods.

It is also possible to use a tool that is suspended from an electric cable, the tool being fitted with an electric pump that serves to supply the liquid under pressure.

The outside diameter of the assembly made up of the tool and the packer is selected to be smaller than the inside diameter d of the completion equipment EC, so that it can travel axially therealong.

Its length is selected to be a little longer than the length of the zone 8 that is to be treated; it is a few meters long, for example.

FIG. 7 shows the assembly being lowered (arrow F) through the completion equipment EC towards the perforated zone Z that is to be patched.

Once in position in register with this zone, the assembly is held stationary, as shown in FIG. 7A.

A high pressure liquid LHP is then fed into each of the inflatable packers 3 via the channel 6 (arrow I) and the orifices 6 (arrows i). The value of this pressure is selected to be sufficient to cause the packers to expand radially together with the end portions 5 of the patch, against which the packers bear.

Figure 7B:
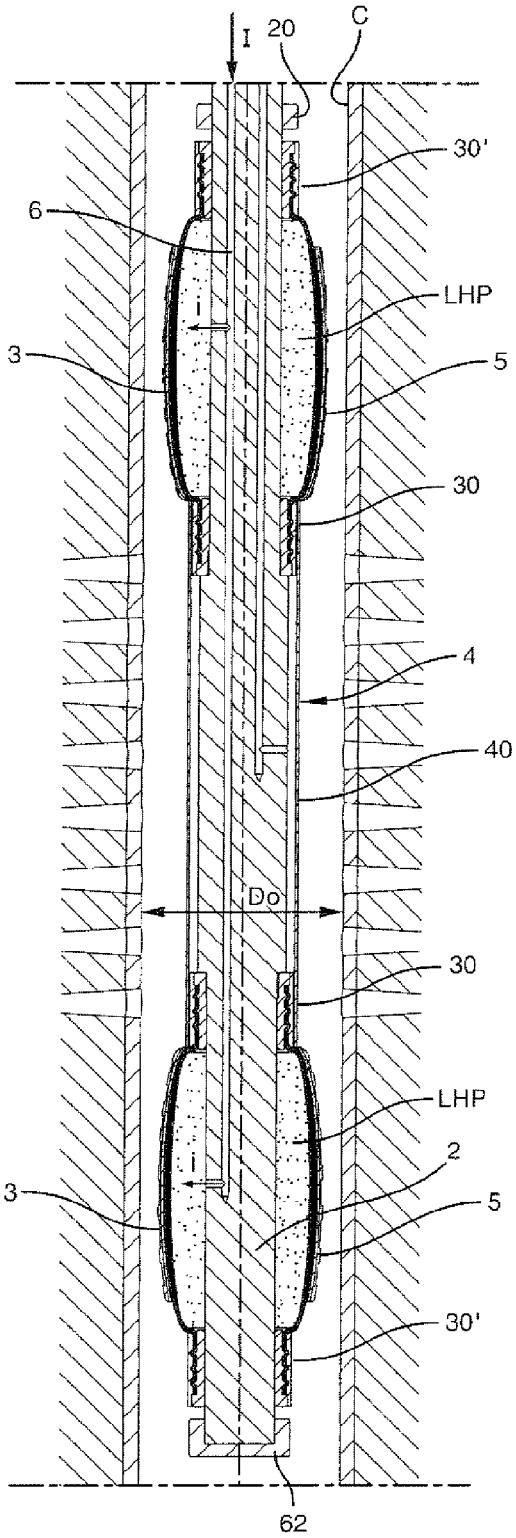
Figure 7B:
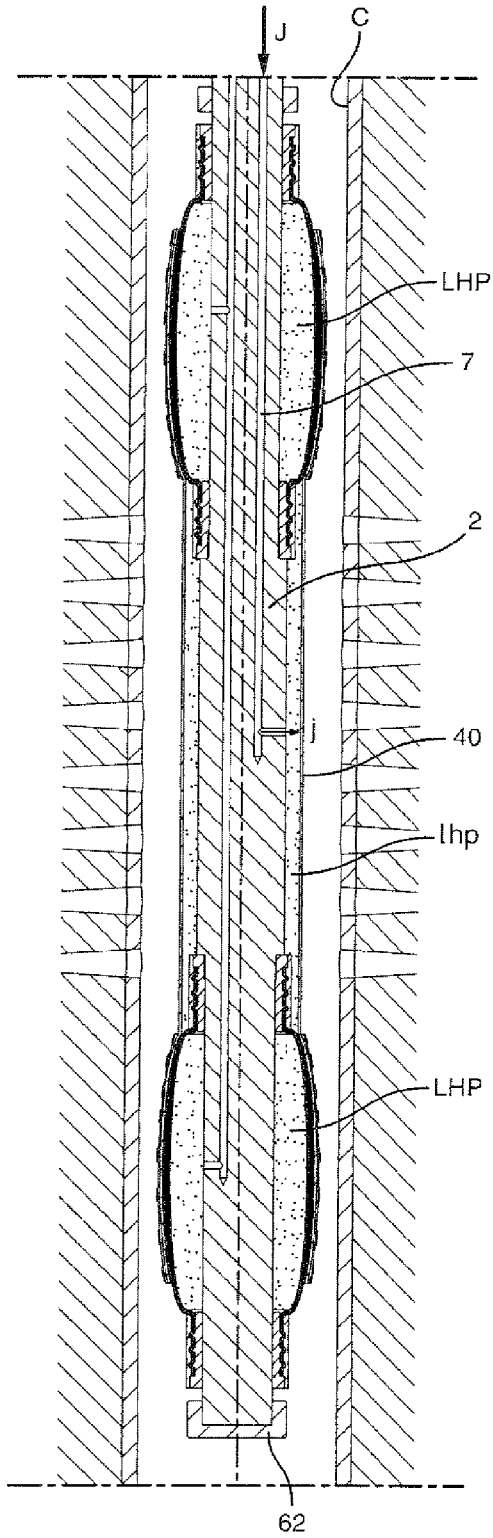

This situation is shown in FIG. 7B.

When the increase in the diameter of said end portions 5 has reached a given value, said diameter nevertheless remaining less than $D_0$, a second high pressure fluid lhp is fed to the inside of the patch 4 between the two inflatable packers 3 via the channel 7 and the orifices 70 (arrows j). During this operation, the liquid LHP is maintained at high pressure in each of the Inflatable packers 3.

The pressure of the second fluid lhp is significantly lower than that of the first fluid LHP, while nevertheless being sufficient to cause the central portion 40 of the patch to expand radially, its wall not being reinforced.

The pressure difference, e.g. about 5 megapascals (MPa), or 50 bars, is selected to be sufficient to prevent the fluid lhp escaping in unwanted manner to the outside of the patch between the outside walls of the packers and the inside wall of the patch.

The central portion 40 of the patch is thus expanded radially by hydroforming.

When its diameter reaches a sufficient given diameter, somewhat less than the maximum diameter of the portions 5, and as shown in FIG. 7'B, the operation is stopped.

These two phases are repeated one or more times until the central portion 40 reaches the desired diameter, after which the packers are again inflated under high pressure so as to press the end portions hermetically against the inside wall of the casing C, of diameter $D_0$.

The pressure of each liquid can be controlled so as to obtain the desired deformations of the end portions 5 and of the central portion 40.

Naturally, the radial expansion of each portion of the patch leads automatically to a reduction in the wall thickness of said portion.

Figure 7C:
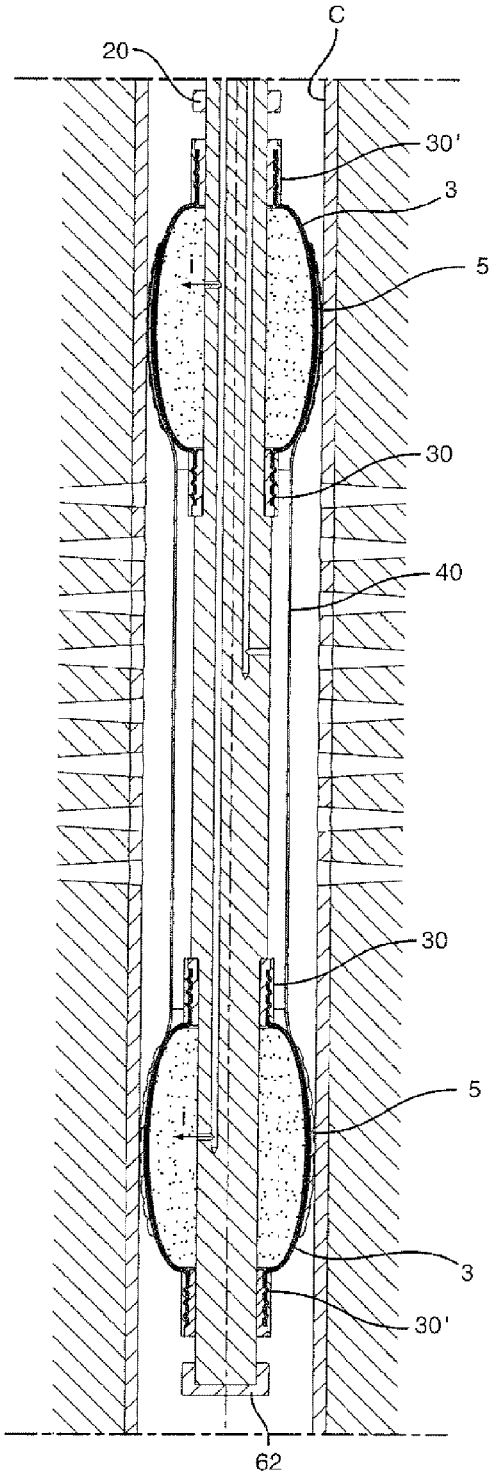

FIG. 7C shows an intermediate stage corresponding to the portions 5 coming into contact with the inside wall of the casing C.

Figure 7D:
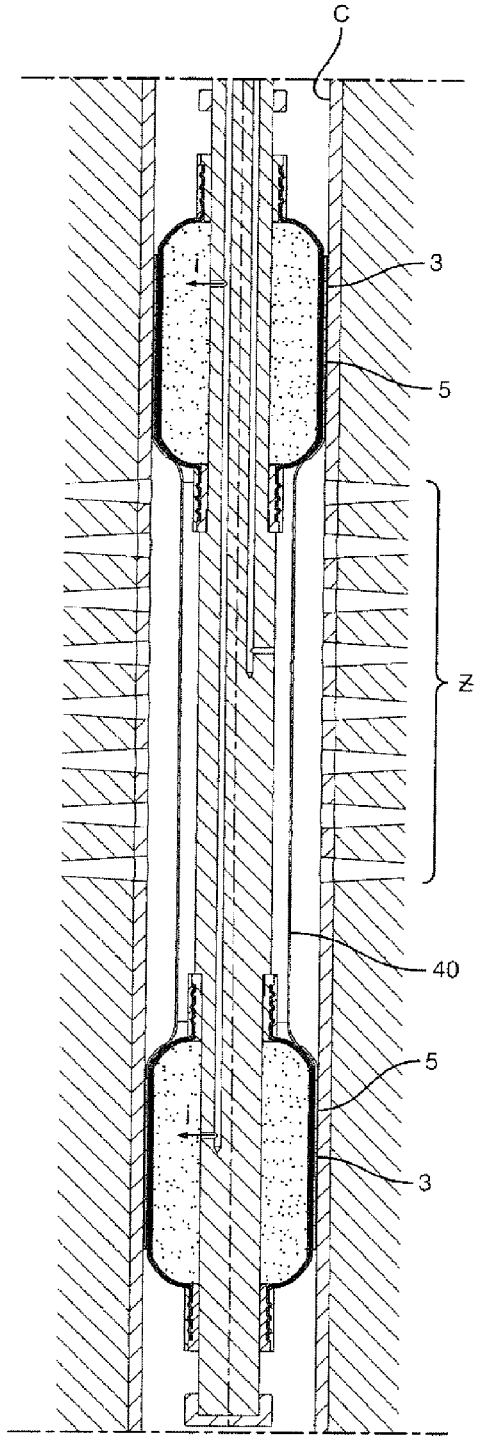

As shown in FIG. 7D, the end portions 5 end up taking on a "tulip" shape with a cylindrical portion pressing intimately and firmly in leaktight manner against the inside wall of the casing 3.

Figure 7E:
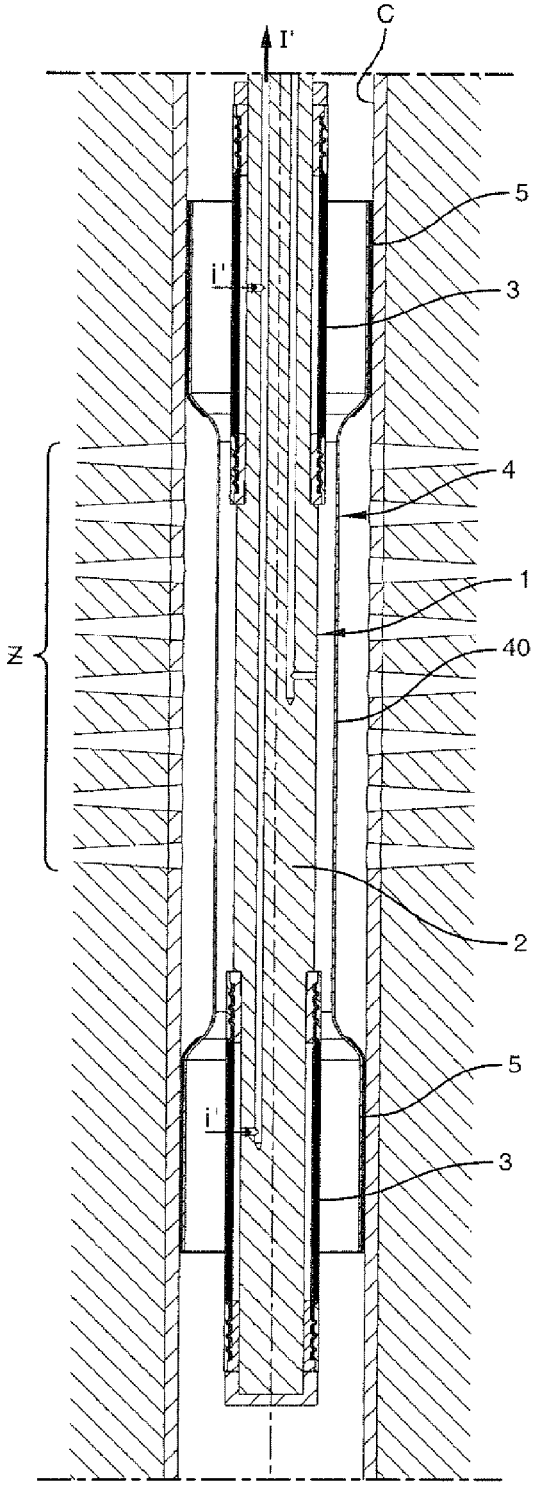
Figure 7E:
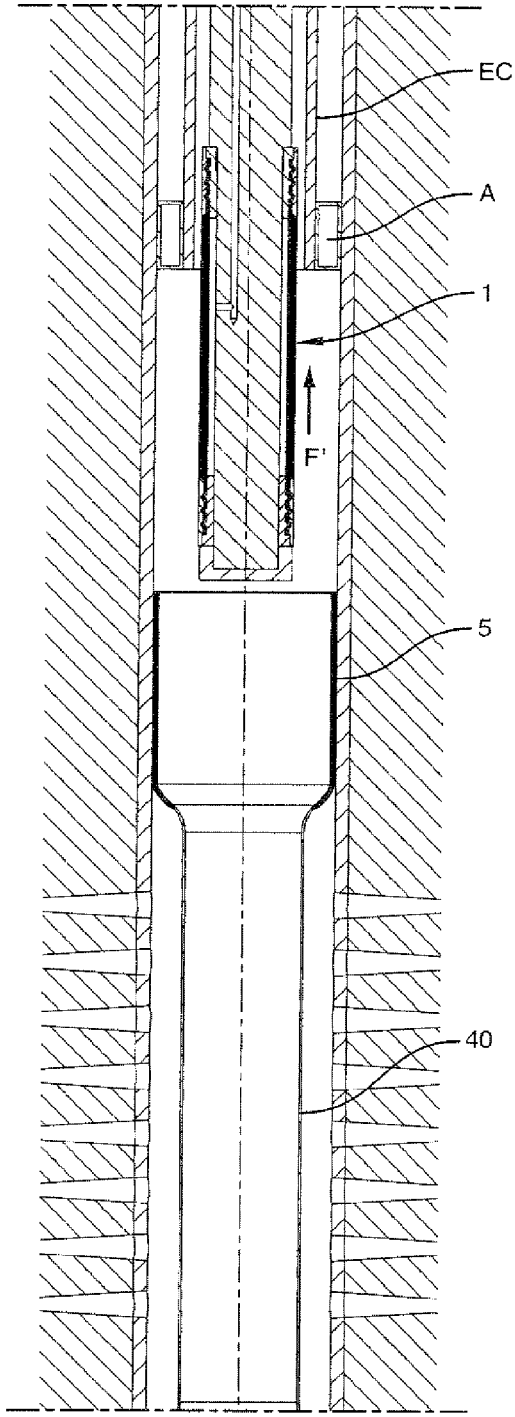

Thereafter, the packers 3 are deflated so that they return to the initial cylindrical shape due to the reduction in pressure, thus allowing liquid to escape via the orifices 60 (arrows i') and the channel 6 (arrow l'), as shown in FIG. 7E. The liquid lhp that was trapped between the inflated packers 3 inside the patch can then escape freely into the well.

The tool can then be withdrawn from the well (arrow F') by being passed back through the completion equipment EC, as shown in FIG. 7'E.

This leaves the configuration shown in FIG. 8 in which the zone Z is lined with the tubular metal patch 4 that has been expanded and secured to the casing C. Because of the leaktight connections between the portions 5 and the wall of the casing, the perforations p are completely isolated and do not harm operation of the well.

The minimum diameter D of the patch 4 is greater than the diameter d of the completion equipment EC, so that it too does not impede operation of the well. It can be advantageous to limit the expansion of the central portion 40 so that a relatively large angular space exists around its periphery, which space can be used, for example, to receive certain pieces of equipment such as sensors, and as explained below.

The patch 8 shown in FIGS. 9 and 10 possesses a wall that is generally cylindrical, but the wall is folded in the longitudinal direction.

This folding is performed over the entire length of the patch.

As in the embodiment above, the end portions 81 are reinforced relative to the central portion 80, and the end portions 81 are lined with a sealing coating.

As can be seen in FIG. 1-0, the wall of the patch presents corrugations 9 giving it a somewhat "daisy" shape.

These folds lie outside a cylindrical envelope 90, and in the deflated state the packers of the tool that is used must naturally possess a diameter that is smaller than or equal to the diameter of said envelope, so that the tool can be approximately engaged inside the patch.

This folded shape enables the central portion 8 to be expanded to a relatively large extent.

Figure 10B:
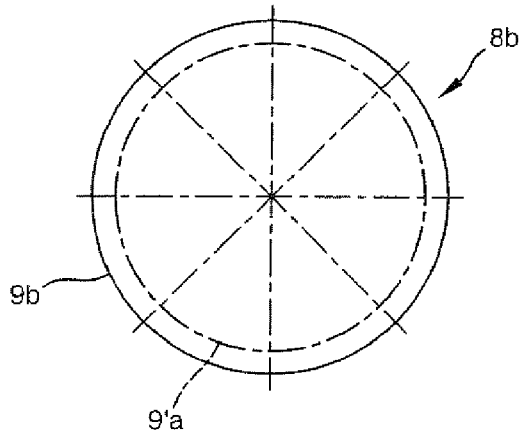

Under the effect of the pressure of the internal fluid lhp, the corrugations 9*a* of the central portion 8*a* are observed initially to deploy progressively (FIG. 10A) with the wall being "rounded", ending up by becoming cylindrical (reference 9'*a*), after which it is observed to expand radially (FIG. 10B) while retaining its cylindrical shape (reference 9*b*).

At the end of expansion, the central portion 80 of the patch is strictly cylindrical, being of constant diameter along its entire length.

Its end portions are also cylindrical, and of greater diameter.

A given tool can be used several times over for putting a plurality of patches into place in a single well or in different wells.

The patch can be put into place by passing through a patch that has already been put into place.

The nature of the metal used and is mechanical characteristics, and in particular its ductility, and also its wall thicknesses, are naturally selected as a function of the stresses to which the patch is to be subjected, in particular the required degree of radial expansion. Similarly, the values of the hydraulic pressures used are adapted to these constraints.

Purely by way of indication, certain possible ranges of dimensions for a patch in accordance with the invention are given below.

Length of the central portion 40: lying in the range 2 m to 12 m; e.g. 10 m.

Length of the end portions 5: lying in the range 0.3 m to 1 m; e.g. 0.5 m.

Diameter before expansion: lying in the range 80 mm to 120 mm (e.g. 100 mm)

Diameter after expansion is complete: lying in the range 100 μm to 150 mm (e.g. 130 mm) for the central portion 40, and lying in the range 120 mm to 180 mm (e.g. 155 mm) in the end portions 5.

In the oily industry, it is often necessary to place sensors, e.g. temperature sensors, pressure sensors, sensors for sensing the pressure of a gas or of some other given substance, etc., inside a well, close to its wall. Once in place, such sensors need to be protected, to be sheltered from tools or other elements that might be passed along the well.

The invention provides a convenient and reliable way of putting such sensors into place, and enables them to be thoroughly isolated inside the well once they have been put into place.

FIG. 11 shows a patch 4 whose cylindrical portion 40 carries a sensor 100; it may be cylindrical in shape, and of diameter that is considerably smaller than that of the patch. It is positioned longitudinally, along a generator line of the patch, and is adjacent to its central portion 40.

Appropriate fastener means, such as a pair of resilient annular straps L1 and L2 serve to hold it in place.

These straps do not impede radial expansion of the portion 40 (FIG. 11A).

The patch 4 is put into place as described above.

As can be understood on examining FIG. 12A, after the patch 4 has been put into place, the sensor 100 is thoroughly isolated inside the casing C in the peripheral space that surrounds the central portion 40, which space is hermetically sealed at both ends by the expanded portions 5.

Naturally, a plurality of sensors could be placed around the patch before it is put into place.

In the variant shown in FIGS. 13 to 15, the central portion presents a small longitudinal depression 400 made by stamping and serving initially to house the sensor. By means of this arrangement, the sensor does not project outside the cylindrical envelope of the patch, thus avoiding any risk of the sensor catching and possibly being damaged while the tool and patch assembly is being lowered down the well, in particular through its completion equipment.

During the expansion of the patch, the setback in the wall 400 deploys like the corrugations in the folded patch shown in FIGS. 9 and 10, so the central portion 40 takes on a cylindrical shape.

Naturally, it is possible to provide a plurality of setbacks in the wall that are shaped and dimensioned so that each of them is suitable for receiving a sensor, should provision be made for putting a plurality of sensors into place.

The invention claimed is:

1. A method of patching a well or a pipe having a zone for treatment by hydroforming a tubular metal patch of initial diameter that is considerably smaller than that of the well or the pipe, the method comprising the following steps:

axially inserting inside said patch a tool comprising a mandrel on which are mounted two inflatable packers that can be expanded radially under the action of internal hydraulic pressure, these two packers being axially spaced apart from each other by a distance that is substantially equal to or a slightly less than the length of the patch;

positioning said tool inside the patch with the packers in register with end portions of the patch;

axially inserting in the well or the pipe an assembly comprising the tool and the patch, and positioning the assembly in register with the zone to be patched;

inflating said packers under high pressure sufficient to cause the end portions of the patch to expand radially and to be pressed in leaktight manner against the inside wall of the well or the pipe; and deflating said packers and withdrawing the tool from the well or the pipe, wherein the patch comprises a central portion and mechanically reinforced end portions, the mechanically reinforced end portions having a thickness greater than the thickness of the central portion so that their resistance to deformation in radial expansion is greater than that of the central portion.

2. A method according to claim 1, wherein after said packers have been inflated, at least in part, for the purpose of pressing the two end portions of the patch in leaktight manner against the inside wall of the well or the pipe, a second fluid under pressure is introduced into the inside of the patch between the two packers to cause the central portion of the patch to expand radially by hydroforming, the inflation pressure of the packers being substantially greater than the pressure of said second fluid.

3. A method according to claim 2, comprising a plurality of stages, each stage comprising two successive phases, in which:

a) in a first phase, the end portions are caused to expand radially to obtain a determined increase in the diameter of said portions, by inflating the packers to a given pressure that is directly a function of the desired increase in diameter; and b) in a second phase, the central portion is expanded by hydroforming under action of a smaller pressure, selected to obtain an increase in its diameter to a desired value;

the operation is repeated one or more times until reaching a desired expansion diameter for the central portion, and the end portions are expanded so that they press intimately and in leaktight manner against the inside wall of the well or the pipe.

4. A method according to claim 1, wherein when said tool has been positioned inside the patch, the packers are inflated a little to secure the tool relative to the patch by friction.

5. A method according to claim 1, wherein at least one sensor is placed between the central portion of the patch and the inside wall of the well or the pipe, said sensor being secured to the outside of the central portion prior to the operation.

6. A tubular patch suitable for use in a method of patching a well or a pipe, having a zone to be patched by hydroforming a tubular metal patch of initial diameter that is considerably smaller than that of the well or the pipe, the method comprising the following steps:

axially inserting inside said patch a tool comprising a mandrel on which are mounted two inflatable packers that can be expanded radially under action of internal hydraulic pressure, these two packers being axially spaced apart from each other by a distance that is substantially equal to or a slightly less than the length of the patch;

positioning said tool inside the patch with the packers in register with end portions of the patch;

axially inserting in the well or the pipe an assembly comprising the tool and the patch, and positioning the assembly in register with the zone to be patched;

inflating said packers under high pressure sufficient to cause the end portions of the patch to expand radially and to be pressed in leaktight manner against the inside wall of the well or the pipe; and deflating said packers and withdrawing the tool from the well or the pipe, wherein the end portions of the patch are mechanically reinforced and have a thickness greater than the central portion so that their resistance to deformation in radial expansion is greater than that of the central portion, and wherein the end portions of the patch are provided with an outer covering suitable for improving sealing on coming into contact with the inside wall of the well or the pipe.

7. A patch according to claim 6 wherein the patch is reinforced in its end portions by means of an outer ring acting as a hoop and engaged on its wall.

8. A patch according to claim 6, wherein said outer covering is of a material that swells, being suitable for expanding on coming into contact with a liquid.

9. A patch according to claim 6, wherein the central portion includes a wall that is folded longitudinally to form corrugations, thus facilitating radial expansion by deploying its corrugations under the effect of internal pressure.

10. A patch according to claim 6, additionally comprising at least one sensor secured to the central portion on the outside of its wall.

11. A patch according to claim 10, wherein the sensor is received in a setback in the wall of the central portion.

* * * * *